US006319661B1

(12) United States Patent
Shor et al.

(10) Patent No.: US 6,319,661 B1
(45) Date of Patent: Nov. 20, 2001

(54) INFRARED SENSITIZED, PHOTOTHERMOGRAPHIC ARTICLE

(75) Inventors: Steven M. Shor, Woodbury; James B. Philip, Jr., Mahtomedi, both of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/695,522

(22) Filed: Oct. 24, 2000

Related U.S. Application Data

(63) Continuation of application No. 08/297,598, filed on Aug. 29, 1994, now abandoned, which is a continuation of application No. 08/072,153, filed on Jun. 4, 1993, now abandoned.

(51) Int. Cl.[7] ..... G03C 1/498; G03C 1/815

(52) U.S. Cl. ..... 430/619; 510/513; 510/517; 510/568; 510/944

(58) Field of Search ..... 430/619, 568, 430/567, 510, 944, 513, 517

(56) References Cited

U.S. PATENT DOCUMENTS

| | | | | |
|---|---|---|---|---|
| 3,909,271 | * | 9/1975 | Ikenoue et al. . | |
| 4,161,408 | | 7/1979 | Winslow et al. . | |
| 4,435,499 | | 3/1984 | Reeves . | |
| 4,476,220 | * | 10/1984 | Penfound | 430/569 |
| 4,725,534 | * | 2/1988 | Kagami et al. . | |
| 4,835,096 | * | 5/1989 | Lea . | |
| 4,839,265 | | 6/1989 | Ohno et al. . | |
| 4,871,656 | | 10/1989 | Parton et al. . | |
| 4,882,265 | | 11/1989 | Laganis et al. . | |
| 5,135,842 | * | 8/1992 | Kitchin et al. . | |
| 5,196,300 | * | 3/1993 | Urabe et al. . | |
| 5,258,282 | * | 11/1993 | Kagami et al. . | |

FOREIGN PATENT DOCUMENTS

| | | |
|---|---|---|
| 0 251 282 A2 | 1/1988 | (EP) . |
| 0 523 465 A1 | 1/1993 | (EP) . |
| 0 559 228 A1 | 9/1993 | (EP) . |
| HEI4[1992]-51043 | 2/1992 | (JP) . |

* cited by examiner

*Primary Examiner*—Thorl Chea
(74) *Attorney, Agent, or Firm*—Mark A. Litman; J. Lanny Tucker

(57) ABSTRACT

An infrared sensitized photothermographic silver halide element comprising a support layer having on at least one surface thereof a photothermographic composition comprising a binder, a light insensitive silver source, a reducing agent for silver ion and infrared radiation sensitive preformed silver halide grains having number average particle size of <0.10 micron with at least 80% of all grains with ±0.05 microns of the average, in combination with an antihalation layer having an absorbance ratio of IR absorbance (before exposure)/visible absorbance (after processing) >30, and an IR absorbance of at least 0.3 within the range of 750–1400 and an optical density of less than 0.03 in the visible region.

13 Claims, No Drawings

INFRARED SENSITIZED, PHOTOTHERMOGRAPHIC ARTICLE

CROSS-REFERENCE TO RELATED APPLICATIONS

This is a Continuation of U.S. Ser. No. 08/297,598 filed Aug. 29, 1994 now abandoned, which is a Continuation of 08/072,153, filed Jun. 4, 1993, now abandoned.

FIELD OF THE INVENTION

This invention relates to an infrared sensitized, photothermographic article composed of a preformed silver halide grain of less than 0.10 micron and an antihalation system with an infrared peak absorbance to visible ratio of greater than or equal to 30 to 1 either before heat processing (with non-thermal bleach systems) or after heat processing where thermal bleach systems would effectively reduce visible absorbance. A further improvement on this invention is the incorporation of supersensitizers to enhance the infrared sensitivity of the article.

BACKGROUND OF THE INVENTION

There is a need in the art for a photothermographic material for medical diagnostic and graphic arts use that has the ability to be efficiently, exposed by laser imagesetters or laser imagers and has the ability to form sharp black images of high resolution and sharpness. The goal is to eliminate the use of wet processing chemicals and to provide a simpler environmentally friendly thermal system to the customer.

Light sensitive recording materials may suffer from a phenomenon known as halation which causes degradation in the quality of the recorded image. Such degradation may occur when a fraction of the imaging light which strikes the photosensitive layer is not absorbed but passes through to the film base on which the photosensitive layer is coated. A portion of the light reaching the base may be reflected back to strike the photosensitive layer from the underside. Light thus reflected may, in some cases, contribute significantly to the total exposure of the photosensitive layer. Any particulate matter in the photosensitive element may cause light passing through the element to be scattered. Scattered light which is reflected from the film base will, on its second passage through the photosensitive layer, cause exposure over an area adjacent to the point of intended exposure. It is this effect which leads to image degradation. Photothermographic materials are prone to this form of image degradation since the photosensitive layers contain light scattering particles. The effect of light scatter on image quality is well documented and is described, for example, in T. H. James "The Theory of the Photographic Process", 4th Edition, Chapter 20, Macmillan 1977.

It is common practice to minimize the effects of light scatter by including a light absorbing layer within the photothermographic element. To be effective, the absorption of this layer must be at the same wavelengths as the sensitivity of the photosensitive layer. In the case of imaging materials coated on transparent base, a light absorbing layer is frequently coated on the reverse side of the base from the photosensitive layer. Such a coating, known as an "antihalation layer", effectively prevents reflection of any light which has passed through the photosensitive layer.

A similar effect may be achieved by a light absorbing layer interposed between the photosensitive layer and the base. This construction, described as an "antihalation underlayer" is applicable to photosensitive coatings on transparent or non-transparent bases. A light absorbing substance may be incorporated into the photosensitive layer itself, in order to absorb scattered light. Substances used for this purpose are known as "acutance dyes". It is also possible to improve image quality by coating a light absorbing layer above the photosensitive layer of a photographic element. Coatings of this kind, described in U.S. Pat. Nos. 4,581,323 and 4,312,941 prevent multiple reflections of scattered light between the internal surfaces of a photographic element.

Photothermographic antihalation systems for infrared materials have been described previously. However these usually had some disadvantages. A strippable antihalation coating of infrared absorbing pigment such as carbon black is described in U.S. Pat. Nos. 4,477,562 and 4,409,316. A strippable layer would generally have adhesion difficulties in processes such as coating, converting and packaging and also generates a sheet of pigmented waste material. For these reasons, it is not a desirable solution to the problem.

European Patent Application 0 377 961 and U.S. Pat. No. 4,581,325 describe infrared antihalation systems for photographic and photothermographic materials incorporating polymethine and holopolar dyes respectively. However, these dyes although having good infrared absorbance, have visible absorbance that is too high for use in subsequent exposures.

Antihalation systems that would satisfy the requirement of an IR/visible absorbance ratio of 30 to 1 would be the thermal-dye-bleach construction described in European Patent Application 0 403 157. The bleaching, infrared antihalation system uses a polymethine dye which is converted to a colorless derivative on heat processing. However, the system is not heat stable and as the dye decomposes,the IR absorbance decreases with time.

A second IR antihalation construction with a 30 to 1, IR/visible ratio can be prepared with indolenine dyes. Indolenine dyes have been described as IR antihalation dyes in silver halide, photographic materials in U.S. Pat. Nos. 2,895,955; 4,882,265; 4,876,181; 4,839,265 and 4,871,656 and Japanese Patent Kokai J63 195656. Infrared absorbing indolenine dyes have been described for electrophotography in U.S. Pat. No. 4,362,800, for optical laser recording material in Japanese Patent Kokai J6 2082-082A and J6 3033-477 and for photothermographic materials in Japanese Patent Kokai J4 182640.

In addition to proper antihalation, a critical step in attaining proper sensitometric properties is the addition of photosensitive silver halide. It is well known in the art that the addition of silver halide grains to a photothermographic formulation can be implemented in a number of ways but basically the silver halide is either made "ex situ" and added to the organic silver salt or made "in situ" by adding a halide salt to the organic silver salt. The addition of silver halide grains in photothermographic materials is described in *Research Disclosure,* June 1978, Item No. 17029. It is also claimed in the art that when silver halide is made "ex situ" one has the possibility to control the composition and size of the grains much more precisely so that one can impart more specific properties to the photothermographic element and can do so much more consistently than with the "in situ" technique.

Other performance characteristics influenced by the silver halide component and ones that are desired to achieve high quality photothermographic material for medical and graphic arts applications are; increased development efficiency, are desired to achieve high quality photothermographic materials for medical and graphic arts applications, are increased development efficiency, increased photographic speed, increased maximum density and lower Dmin and lower haze. U.S. Pat. No. 4,435,499 claims that these characteristics are not well addressed by conventionally prepared cubic grain silver halide gelatino photographic emulsions used in "ex situ" formulations. In fact, they claim advantages for tabular grains that give increased speed while maintaining a high surface area so that silver efficiency remains high. However it is well known that tabular grains give broad distributions which usually results in photosensitive materials of lower contrast than monomodal distributions. This is undesireable for our intended applications.

While the patent demonstrates increased speed and increased development efficiency, they do not show that increased Dmax is attained or that Dmin and haze remain lower than if very fine conventional cubic grains are used. In fact, it is known that larger grains tend to give high levels of haze.

Infrared supersensitization of photographic and photothermographic materials in order to attain increased sensitivity is described in detail in U.S. patent application Ser. No. 07/846,919 filed Apr. 13, 1992.

BRIEF DESCRIPTION OF THE INVENTION

According to the present invention there is provided a photothermographic article comprising one or more photosensitive layers containing a preformed silver halide emulsion of grains having a number average grain size of less than 0.10 micron and an antihalation or acutance dye which has an infrared peak absorbance (before processing) to visible absorbance (before and/or after processing) ratio of greater than or equal to 30 to 1. A further improvement is the incorporation of supersensitizers to enhance the infrared sensitivity of the article. Combining ultrafine grains with the supersensitizers described provides a high speed, high Dmax, high efficiency, low Dmin, and low haze material which is useful as a laser exposed film for both graphic arts and diagnostic imaging applications. When the above element is provided with the proper antihalation, one can attain these properties with excellent image sharpness.

DETAILED DESCRIPTION OF THE INVENTION

To date, photothermographic systems have not been useful for medical diagnostic or graphic arts laser recording purposes because of slow speed, low Dmax, poor contrast and insufficient sharpness at high Dmax. This invention describes an antihalation system, preformed silver halide grains less than 0.10 micron and infrared supersensitization leading to an infrared photothermographic article reaching the requirements for medical or graphic arts laser recording applications.

One aspect of this invention is a photothermographic, infrared antihalation system which absorbs strongly in the infrared (≧0.30 transmission absorbance at IR peak absorbance before processing) with a very low visible absorbance (≦0.01) before and/or after processing. The ratio of IR absorbance to visible absorbance is measured by determining the transmission optical density of the layer at the wavelength of maximum absorbance in the IR ($OD_{TIR}$) and the transmission optical density of the same layer as an average value over the visible ($OD_{TVIS}$) region of the spectrum. The infrared is defined as 750–1400 nm and the visible range is 360–700 nm for the purposes of this invention. A further aspect was to achieve a low absorbance at 380 nm to facilitate graphic art applications such as contact printing.

A second part of this invention is the use of preformed silver halide grains of less than 0.10 microns in an infrared sensitized, photothermographis material. Preferably the number average particle size of the grains is between 0.01 and 0.08 microns, more preferably between 0.03 and 0.07 microns, and most preferably between 0.04 and 0.06 microns.

The preferred supersensitizers for this invention are the ones described in U.S. patent application Ser. No. 07/846,919 and include heteroaromatic mercapto compounds or heteroaromatic disulfide compounds.

An infrared antihalation system that satisfies the requirement of an IR/visible absorbance (preferably transmission, but also displays an absorbance ratio of 30 to 1 before and after processing can be achieved with non-bleaching indolenine dyes of formula I:

(I)

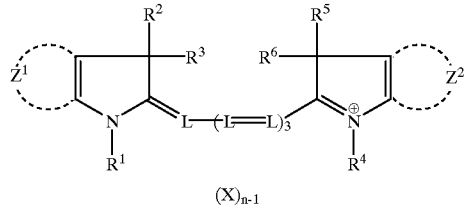

wherein $R^1$, $R^2$, $R^3$, $R^4$, $R^5$, and $R^6$ are the same or different, each represents substituted or unsubstituted alkyl groups; and each of $Z^1$ and $Z^2$ represents a group of non-metallic atoms (e.g., selected from C, S, N, O and Se) necessary for the formation of a substituted or unsubstituted benzo-condensed ring or naphtho-condensed ring. Among the groups $R^1$, $R^2$, $R^3$, $R^4$, $R^5$, $R^6$, $Z^1$, and $Z^2$ there may be one or more groups having an acid substituent group (e.g., sulfonic group and carboxylic group) or one or more sulfonamide groups.

Sulfonic group includes a sulfo group or a salt thereof, and the carboxylic group represents a carboxyl group or a salt thereof. Examples of the salt include alkali metal salts (e.g., Na and K), ammonium salts, and organic ammonium salts (e.g., triethylamine, tributylamine, and pyridine).

L represents a substituted or unsubstituted methine group; and X represents an anion. Examples of the anion represented by X include halogen ions (such as Cl, Br and I), p-toluenesulfonic acid ion, and ethyl sulfate ion.

n represents 1 or 2; it is 1 when the dye forms an inner salt. Nonamethime counter parts of these dyes can also be used, but they are more difficult to work with than the heptamethines.

The alkyl groups represented by $R^1$, $R^2$, $R^3$, $R^4$, $R^5$ and $R^6$ are preferably lower alkyl groups (e.g., methyl group, ethyl group, n-propyl group, n-butyl group, isopropyl group, and n-pentyl group) having 1 to 5 carbon atoms. They may have a substituent group such as a sulfonic group, carboxyl group or hydroxyl group.

More preferably, $R^1$ and $R^4$ are $C_1$–$C_5$ lower alkyl groups or $C_1$–$C_5$ lower alkyl groups having a sulfonic acid group (e.g., 2-sulfoethyl group, 3-sulfopropyl group, and 4-sulfobutyl group).

The benzo-condensed ring or naphtho-condensed ring formed by the group of non-metallic atoms represented by $Z^1$ and $Z^2$ may have a substituent group such as sulfonic acid group, carboxyl group, sulfonamide group, hydroxy group, halogen atom (e.g., F, Cl, and Br), cyano group, and substituted amino group (e.g., dimethylamino group, diethylamino group, ethyl-4-sulfobutylamino group, and di(3-sulfopropyl)amino group). Another example of a useful substituent group is a substituted or unsubstituted alkyl group containing from 1 to 5 carbon atoms connected to the ring directly or through a divalent connecting group. Examples of the alkyl group include methyl group, ethyl group, propyl group, and butyl group; examples of the substituent group introduced thereto include sulfonic acid group, carboxyl group, and hydroxyl group; and examples of the divalent connecting group include —O—, —NHCO—, —NH—$SO_2$—, —NHCOO—, —NHCONH—, —COO—, —CO—, and —$SO_2$—.)

The substituent group on the methine group designated by L includes substituted or unsubstituted lower alkyl groups containing from 1 to 5 carbon atoms (e.g., methyl group, ethyl group, 3-hydroxypropyl group, benzyl group, and 2-sulfoethyl group), halogen atoms (e.g., F, Cl and Br), substituted or unsubstituted aryl groups (e.g., phenyl group and 4-chlorophenyl group), and lower alkoxy groups (e.g., methoxy group and ethoxy group). One substituent group on the methine group designated by L may be connected to another substituent group on the methine group to form a ring (e.g., 4,4-dimethylcyclohexene, cyclopentene or cyclohexene ring) containing three methine groups.

The dye compound represented by formula (I) described above and used in this invention is illustrated by examples in the following; however, the scope of this invention is not limited to them.

D-1

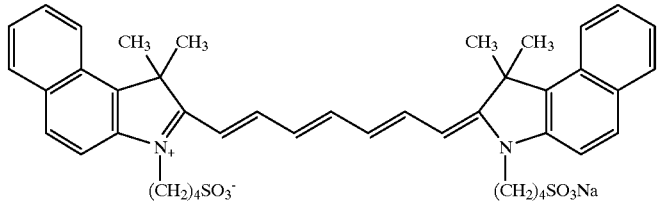

D-2

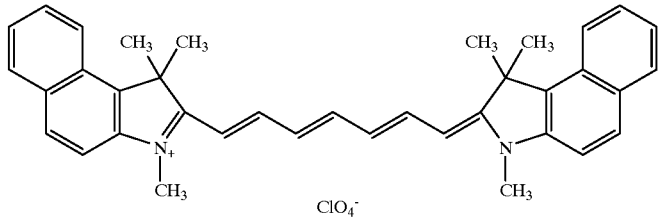

D-3

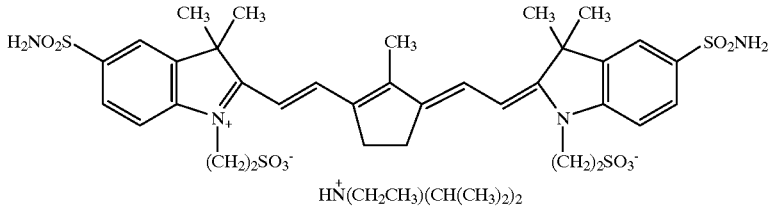

D-4

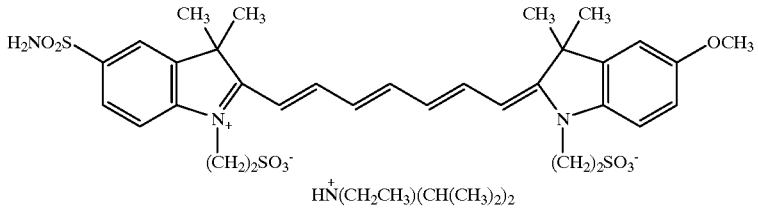

D-5

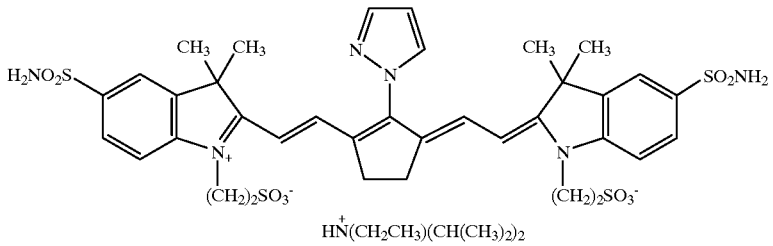

-continued

D-6

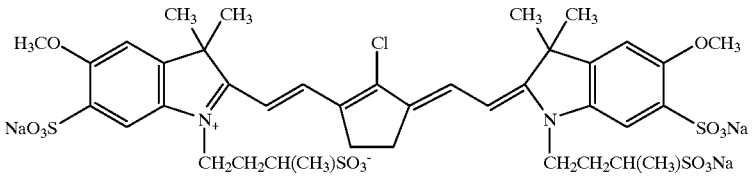

D-7

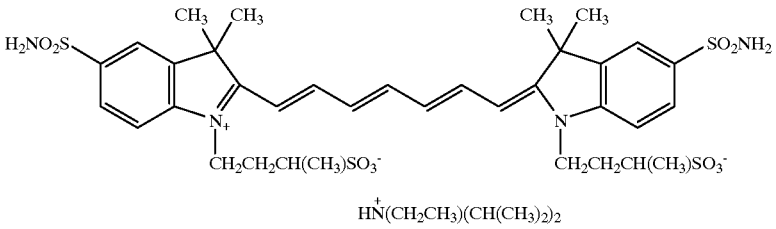

D-8

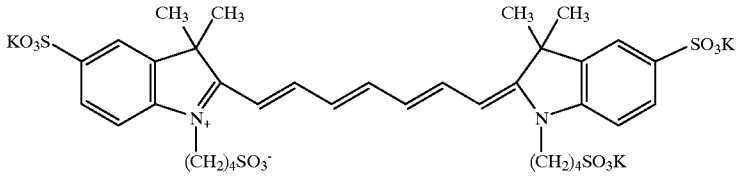

The dyes may be incorporated into photothermographic elements as acutance dyes according to conventional techniques. The dyes may also be incorporated into antihalation layers according to techniques of the prior art as an antihalation backing layer, an antihalation underlayer or as an overcoat. It is also anticipated that similar nonamethine dyes would be suitable for use as acutance and antihalation dyes.

A dye of formula (I) was shown in U.S. patent application Ser. No. 07/846,919 to be a weak infrared sensitizer in photothermographic systems. However, the minimum amount of dye of formula (I) for use for acutance purposes greatly exceeds the maximum amount of dye used for sensitizing purposes. For example, the quantity of sensitizing dye used in the photothermographic emulsion disclosed in U.S. patent application Ser. No. 07/846,919 was 3.1 mg/meter$^2$ whereas for acutance purposes in accordance with the invention the dyes would generally be used at a higher level. The dyes of formula (I) are generally added to the photothermographic element in a sufficient amount to provide a transmissive optical density of greater than 0.1 at $\lambda_{max}$ of the dye. Generally, the coating weight of the dye which will provide the desired effect is from 5 to 200 mg/meter$^2$, more preferably as 10 to 150 mg/meter?

An infrared antihalation system that satisfies the requirement of an IR/visible absorbance ratio of 30 to 1 after processing would be the thermal-dye-bleach construction described in European Patent Application 0 403 157. For purposes of good viewing of the image-developed film or exposing through the imaged-developed film it is desirable to have a very low visible absorbance (≦0.01). The dyes, D-9 and D-10, used in the thermal-dye-bleach formula do not have a 30 to 1 ratio of IR/visible absorbance before heat processing. Only after thermal bleaching does the system satisfy the 30 to 1 ratio.

D-9

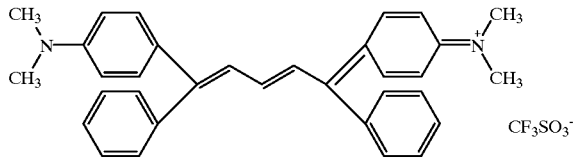

D-10

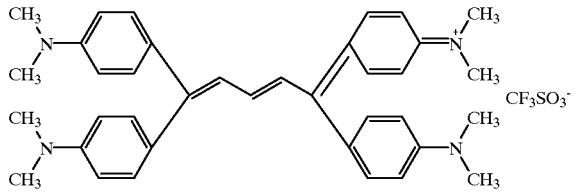

A further improvement in this invention is the addition of supersensitizers to enhance the infrared sensitivity of the article. Any supersensitizer could be used which increases the infrared sensitivity but the preferred supersensitizers are described in U.S. patent application Ser. No. 07/846,919 and include heteroaromatic mercapto compounds (II) or heteroaromatic disulfide compounds (III).

Ar—SM (II)

Ar—S—S—Ar (III)

wherein M represents a hydrogen atom or an alkali metal atom,

Ar represents an aromatic ring or fused aromatic ring containing one or more of nitrogen, sulfur, oxygen, selenium or tellurium atoms. Preferably the heteroaromatic ring is benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the class consisting of halogen (e.g., Br and Cl), hydroxy, amino, carboxy, alkyl (e.g. of 1 or more carbon atoms, preferably 1 to 4 carbon atoms) and alkoxy (e.g. of 1 or more carbon atoms, preferably of 1 to 4 carbon atoms.

The preferred supersensitizers were 2-mercaptobenzimidazole, 2-mercapto-5-methylbenzimidazole and 2-mercaptobenzothiazole.

The supersensitizers are used in general amount of at least 0.001 moles/mole of silver in the emulsion layer. Usually the range is between 0.001 and 1.0 moles of the compound per mole of silver and preferably between 0.01 and 0.3 moles of compound per mole of silver.

The photothermographic dry silver emulsions of this invention may be constructed of one or more layers on a substrate. Single layer constructions must contain the silver source material, the silver halide, the developer and binder as well as any optional additional materials such as toners, coating aids, and other adjuvants. Two-layer constructions must contain the silver source and silver halide in one emulsion layer (usually the layer adjacent to the substrate) and some of the other ingredients in the second layer or both layers, although two layer constructions comprising a single emulsion layer containing all the ingredients and a protective topcoat are envisioned. Multicolor photothermographic dry silver constructions may contain sets of these bilayers for each color, or they may contain all ingredients within a single layer as described in U.S. Pat. No. 4,708,928. In the case of multilayer multicolor photothermographic articles the various emulsion layers are generally maintained distinct from each other by the use of functional or non-functional barrier layers between the various photosensitive layers as described in U.S. Pat. No. 4,460,681.

While not necessary for practice of the present invention, it may be advantageous to add mercury (II) salts to the emulsion layer(s) as an antifoggant. Preferred mercury (II) salts for this purpose are mercuric acetate and mercuric bromide.

The light sensitive silver halide used in the present invention may typically be employed in a range of 0.75 to 25 mol percent and, preferably, from 2 to 20 mol percent of organic silver salt.

The silver halide may be any photosensitive silver halide such as silver bromide, silver iodide, silver chloride, silver bromoiodide, silver chlorobromoiodide, silver chlorobromide, etc. The silver halide may be in any form which is photosensitive including, but not limited to cubic, orthrohombic, tabular, tetrahedral, etc., and may have epitaxial growth of crystals thereon.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in *T. N. James The Theory of the Photographic Process,* Fourth Edition, Chapter 5, pages 149 to 169.

The silver halide may be added to the emulsion layer in any fashion which places it in catalytic proximity to the silver source. Silver halide and the organic silver salt which are separately formed or "preformed" in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are known in the art and described in *Research Disclosure,* June 1978, item 17029, and U.S. Pat. No. 3,700,458.

The use of preformed silver halide emulsions of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to cubic, tetrahedral, orthorhombic, tabular, laminar, platelet, etc.

The light-sensitive silver halides may be advantageously spectrally sensitized with various known dyes including cyanine, merocyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Practically, the sensitizing dyes to be used in the present invention may be properly selected from known dyes such as those described in U.S. Pat. Nos. 3,761,279, 3,719,495, and 3,877,943, British Pat Nos. 1,466,201, 1,469,117 and 1,422,057, and can be located in the vicinity of the photocatalyst according to known methods. Spectral sensitizing dyes may be typically used in amounts of about $10^{-4}$ mol to about 1 mol per 1 mol of silver halide.

The organic silver salt which can be used in the present invention is a silver salt which is comparatively stable to light, but forms a silver image when heated to 80° C. or higher in the presence of an exposed photocatalyst (such as photographic silver halide) and a reducing agent.

The organic silver salt may be any organic material which contains a reducible source of silver ions. Silver salts of organic acids, particularly long chain (10 to 30 preferably 15 to 28 carbon atoms) fatty carboxylic acids are preferred. Complexes of organic or inorganic silver salts wherein the ligand has a gross stability constant between 4.0 and 10.0 are also desirable. The silver source material should preferably constitute from about 5 to 30 percent by weight of the imaging layer.

Preferred organic silver salts include silver salts of organic compounds having a carboxy group. Non-limiting examples thereof include silver salts of an aliphatic carboxylic acid and a silver salt of an aromatic carboxylic acid. Preferred Examples of the silver salts of aliphatic carboxylic acids include silver behenate, silver stearate, silver oleate, silver laurate, silver caproate, silver myristate, silver palmitate, silver maleate, silver fumarate, silver tartrate, silver linoleate, silver butyrate and silver camphorate, mixtures thereof, etc.

Silver salts of compounds containing mercapto or thione groups and derivatives thereof can also be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, a silver salt of thioglycolic acid such as a silver salt of an S-alkyl thioglycolic acid (wherein the alkyl group has from 12 to 22 carbon atoms), a silver salt of a dithiocarboxylic acid such as a silver salt of dithioacetic acid, a silver salt of a thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4 -thiazole, a silver salt of thione compound such as a silver salt of 3-(3-carboxyethyl)-4-methyl-4-thiazoline-2-thione as disclosed in U.S. Pat. No. 3,301,678.

Furthermore, a silver salt of a compound containing an imino group may be used. Preferred examples of these compounds include silver salts of benzothiazole and derivatives thereof, for example, silver salts of benzothiazoles such as silver methylbenzotriazolate, etc., silver salt of halogen-substituted benzotriazoles, such as silver 5-chlorobenzotriazolate, etc., silver salts of carboimidobenzotriazole, etc., silver salt of 1,2,4-triazoles or 1-H-tetrazoles as described in U.S. Pat. No. 4,220,709, silver salts of imidzoles and imidazole derivatives, and the like. Various silver acetylide compounds can also be used, for instance, as described in U.S. Pat. Nos. 4,761,361 and 4,775,613.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver may be used.

The method used for making silver soap dispersions is well known in the art and is disclosed in Research Disclosure,April 1983, item 22812, *Research Disclosure,* October 1983, item 23419 and U.S. Pat. No. 3,985,565.

The reducing agent for the organic silver salt may be any material, preferably organic material, that can reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In multilayer constructions, if the reducing agent is added to a layer other than an emulsion layer, slightly higher proportions, of from about 2 to 15 percent tend to be more desirable.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine, a reductone and/or a hydrazine (e.g., a combination of hydroquinone and bis (ethoxyethyl)hydroxylamine, piperidinohexose reductone or formyl-4-methylphenylhydrazine); hydroxamic acids such as phenylhydroxamic acid, p-hydroxyphenylhydroxamic acid, and β-alininehydroxamic acid; a combination of azines and sulfonamidophenols, (e.g., phenothiazine and 2,6-dichloro-4-benzenesulfonamidophenol); α-cyanophenylacetic acid derivatives such as ethyl-α-cyano-2-methylphenylacetate, ethyl α-cyanophenylacetate; bis-β-naphthols as illustrated by 2,2'-dihydroxyl-1,1'-binaphthyl, 6,6'-dibromo-2,2'-dihydroxy-1,1'-binaphthyl, and bis (2-hydroxy-1-naphthyl)methane; a combination of bis-β-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidonehexose reductone; sulfonamido -phenol reducing agents such as 2,6-dichloro-4-benzenesulfonamidophenol, and p-benzenesulfonamidophenol; 2-phenylindane,-1,3-dione and the like; chromans such as 2,2-dimethyl-7-t-butyl -6-hydroxychroman; 1,4-dihydropyridines such as 2,6-dimethoxy-3,5-dicarbethoxy-1,4-dihydropyridine; bisphenols (e.g., bis(2-hydroxy-3-t-butyl-5-methylphenyl) methane, 2,2,-bis(4-hydroxy-3-methylphenyl)propane, 4,4-ethylidene-bis(2-t-butyl-6-methylphenol), and 2,2-bis(3,5-dimethyl-4-hydroxyphenyl)propane); ascorbic acid derivatives (e.g., 1-ascorbyl palmitate, ascorbyl stearate); and aldehydes and ketones, such as benzil and biacetyl; 3-pyrazolidones and certain indane-1,3-diones.

In addition to the aformementioned ingredients it may be advantageous to include additives known as "toners" that improve the image. Toner materials may be present, for example, in amounts from 0.1 to 10 percent by weight of all silver bearing components. Toners are well known materials in the photothermo-graphic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and quinazolinone, 3-phenyl-2-pyrazoline-5-one, 1-phenylurazole, quinazoline, and 2,4-thiazolidinedione; naphthalimides (e.g., N-hydroxy-1,8-naphthalimide); cobalt complexes (e.g., cobaltic hexammine trifluoroacetate); mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, (e.g., (N,N-dimethylaminomethyl)phthalimide, and N,N-(dimethylaminomethyl)-naphthalene-2,3-dicarboximide); and a combination of blocked pyrazoles, isothiuronium derivatives and certain photobleaching agents (e.g., a combination of N,N'-hexamethylene bis(1-carbamoyl-3,5-dimethyl -pyrazole), 1,8-(3,6-diazaoctane)bis(isothiuronium trifluoroacetate) and 2-(tribromomethylsulfonyl) benzothiazole); and merocyanine dyes such as 3-ethyl-5[(3-ethyl-2-benzo -thiazolinylidene)-1-methylethylidene]-2-thio-2,4-oxazolidinedione; phthalazinone and phthalazinone derivatives or metal salts or these derivatives such as 4-(1-naphthyl)phthalazinone, 6-chlorophthalazinone, 5,7-dimethoxyphthalazinone, and 2,3-dihydro 1,4-phthalazinedione; a combination of phthalazinone plus phthalic acid derivatives (e.g., phthalic acid, 4-methylphthalic acid, 4-nitrophthalic acid, and tetrachlorophthalic anhydride); quinazolinediones, benzoxazine or naphthoxazine derivatives; rhodium complexes functioning not only as tone modifiers, but also as sources of halide ion for silver halide formation in situ, such as ammonium hexachlororhodate (III), rhodium bromide, rhodium nitrate and potassium hexachlororhodate (III); inorganic peroxides and persulfates (e.g., ammonium peroxydisulfate and hydrogen peroxide); benzoxazine-2,4-diones such as 1,3-benzoxazine-2,4-dione, 8-methyl -1,3-benzoxazine-2,4-dione, and 6-nitro-1,3-benzoxazine-2,4-dione; pyrimidines and asymmetric triazines (e.g., 2,4-dihydroxypyrimidine, 2-hydroxy-4-aminopyrimidine), azauracils, and tetrazapentalene derivatives (e.g, 3,6-dimercapto -1,4-diphenyl1H,4H-2,3a,5,6a-tetrazapentalene, and 1,4-di(o-chlorophenyl) -3,6-dimercapto-1H,4H-2,3a,5,6a-tetrazapentalene).

A number of methods are known in the art for obtaining color images with dry silver systems including: a combination of silver benzotriazole, well known magenta, yellow and cyan dye-forming couplers, aminophenol developing agents, a base release agent such as guanidinium trichloroacetate and silver bromide in poly(vinyl butyral as described in U.S. Pat. Nos. 4,847,188 and 5,064,742; preformed dye release systems such as those described in U.S. Pat. No. 4,678,739; a combination of silver bromoiodide, sulfonamidophenol reducing agent, silver behenate, poly(vinyl butyral), an amine such as n-octadecylamine and 2-equivalent or 4-equivalent cyan, magenta or yellow dye-forming couplers; leuco dye bases which oxidize to form a dye image (e.g., Malachite Green, Crystal Violet and pararosaniline); a combination of in situ silver halide, silver behenate, 3-methyl-1-phenylpyrazolone and N,N'-dimethyl-p-phenylenediamine hydrochloride; incorporating phenolic leuco dye reducing agents such as 2(3,5-di-(t-butyl)-4-hydroxyphenyl)-4, 5-diphenylimidazole, and bis(3,5-di-(t-butyl) -4-hydroxyphenyl)phenylmethane, incorporating azomethine dyes or azo dye reducing agents; silver dye bleach processes (for example, an element comprising silver behenate, behenic acid, poly(vinyl butyral), poly(vinyl-butyral) peptized silver bromoiodide emulsion, 2,6-dichloro-4-benzenesulfonamidophenol, 1,8-(3,6-diazaoctane)bis(isothiuronium-p-toluenesulfonate) and an azo dye can be exposed and heat processed to obtain a negative silver image with a uniform distribution of dye, and then laminated to an acid activator sheet comprising polyacrylic acid, thiourea and p-toluenesulfonic acid and heated to obtain well defined positive dye images); and amines such as aminoacetanilide (yellow dye-forming), 3,3'-dimethoxybenzidine (blue dye-forming) or sulfanilide (magenta dye forming) that react with the oxidized form of incorporated reducing agents such as 2,6-dichloro-4-benzenesulfonamidophenol to form dye images. Neutral dye images can be obtained by the addition cholamines such as behenylamine and p-anisidine.

Leuco dye oxidation in such silver halide systems for color formation is disclosed in U.S. Pat. Nos. 4,021,240, 4,374,821, 4,460,681 and 4,883,747.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes." These dyes are prepared by oxidative coupling of a p-phenylenediamine with a phenolic or anilinic compound. Leuco dyes of this class are described in U.S. Pat. No. 4,594,307. Leuco chromogenic dyes having short chain carbamoyl protecting groups are described in assignee's copending application U.S. Ser. No. 07/939,093, incorporated herein by reference.

A third class of dyes useful in this invention are "aldazine" and "ketazine" dyes. Dyes of this type are described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type are described in Japanese Patent No. 52-89131 and U.S. Pat. Nos. 2,784,186; 4,439,280; 4,563,415, 4,570,171, 4,622,395 and 4,647,525, all of which are incorporated herein by reference.

Another class of dye releasing materials that form a dye upon oxidation are known as preformed-dye-release (PDR) or redox-dye-release (RDR) materials. In these materials the reducing agent for the organic silver compound releases a pre-formed dye upon oxidation. Examples of these materials are disclosed in Swain, U.S. Pat. No. 4,981,775, incorporated herein by reference.

The optional leuco dyes of this invention, can be prepared as described in H. A. Lubs *The Chemistry of Synthetic Dyes and Pigments;* Hafner; New York, N.Y.; 1955 Chapter 5; in H. Zollinger *Color Chemistry: Synthesis, Properties and Applications of Organic Dyes and Pigments;* VCH; New York, N.Y.; pp. 67–72, 1987, and in U.S. Pat. No. 5,149,807; and EPO Laid Open Application No. 0,244,399.

Silver halide emulsions containing the stabilizers of this invention can be protected further against the additional production of fog and can be stabilized against loss of sensitivity during shelf storage. Suitable antifoggants, stabilizers, and stabilizer precursors which can be used alone or in combination, include thiazolium salts as described in U.S. Pat. Nos. 2,131,038 and 2,694,716; azaindenes as described in U.S. Pat. Nos. 2,886,437 and 2,444,605; mercury salts as described in U.S. Pat. No. 2,728,663; urazoles as described in U.S. Pat. No. 3,287,135; sulfocatechols oximes as described in British Patent No. 623,448; nitrones; nitroindazoles; polyvalent metal salts as described in U.S. Pat. No. 2,839,405; thiouronium salts as described in U.S. Pat. No. 3,220,839; and palladium, platinum and gold salts described in U.S. Pat. Nos. 2,566,263 and 2,597,915; halogen-substituted organic compounds as described in U.S. Pat. Nos. 4,108,665 and 4,442,202; triazines as described in U.S. Pat. Nos. 4,128,557; 4,137,079; 4,138,265; and 4,459,350; and phosphorous compounds as described in U.S. Pat. No. 4,411,985.

Stabilized emulsions of the invention can contain plasticizers and lubricants such as polyalcohols (e.g., glycerin and diols of the type described in U.S. Pat. No. 2,960,404); fatty acids or esters such as those described in U.S. Pat. Nos. 2,588,765 and 3,121,060; and silicone resins such as those described in British Patent No. 955,061.

The photothermographic elements of the present invention may include image dye stabilizers. Such image dye stabilizers are illustrated by British Patent No. 1,326,889; U.S. Pat. Nos. 3,432,300; 3,698,909; 3,574,627; 3,573,050; 3,764,337 and 4,042,394.

Photothermographic elements containing emulsion layers stabilized according to the present invention can be used in photographic elements which contain light absorbing materials and filter dyes such as those described in U.S. Pat. Nos. 3,253,921; 2,274,782; 2,527,583 and 2,956,879. If desired, the dyes can be mordanted, for example, as described in U.S. Pat. No. 3,282,699.

Photothermographic elements containing emulsion layers stabilized as described herein can contain matting agents such as starch, titanium dioxide, zinc oxide, silica, polymeric beads including beads of the type described in U.S. Pat. Nos. 2,992,101 and 2,701,245.

Emulsions stabilized in accordance with this invention can be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056 and 3,206,312 or insoluble inorganic salts such as those described in U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymers are polyvinyl butyral, butyl ethyl cellulose, methacrylate copolymers, maleic anhydride ester copolymers, polystyrene, and butadiene-styrene copolymers.

Optionally, these polymers may be used in combinations of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing a stabilizer according to the present invention may be coated on a wide variety of supports. Typical supports include polyester film, subbed polyester film, poly(ethylene terephthalate)film, cellulose nitrate film, cellulose ester film, poly(vinyl acetal) film, polycarbonate film and related or resinous materials, as well as glass, paper metal and the like. Typically, a flexible support is employed, especially a paper support, which may be partially acetylated or coated with baryta and/or an α-olefin polymer, particularly a polymer of an α-olefin containing 2 to 10 carbon atoms such as polyethylene, polypropylene, ethylene-butene copolymer and the like. Substrates may be transparent or opaque.

Substrates with a backside resistive heating layer may also be used in color photothermographic imaging systems such as shown in U.S. Pat. Nos. 4,460,681 and 4,374,921.

Photothermographic emulsions of this invention can be coated by various coating procedures including dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095.

Additional layers may be incorporated into photothermographic articles of the present invention such as dye receptive layers for receiving a mobile dye image, an opacifying layer when reflection prints are desired, a protective topcoat layer and a primer layer as is known in the photothermographic art. Additionally, it may be desirable in some instances to coat different emulsion layers on both sides of a transparent substrate, especially when it is desirable to isolate the imaging chemistries of the different emulsion layers.

The invention will now be illustrated by the following Examples:

EXAMPLES 1–3

Experiments were run to determine the preformed silver halide grain size limits for the infrared photothermographic article.

Three silver halide-silver behenate dry soaps were prepared by the procedure described in U.S. Pat. No. 3,839,049 differing only in size of preformed silver halide grains. The three soaps were prepared with 0.055, 0.088 and 0.10 micron silver halide grains. All three preformed silver halide emulsions were silver iodobromide with 2% iodide distributed uniformly throughout the crystal. The silver halide totalled 9 mole % of the total silver while silver behenate comprised 91% (mole) of the total silver.

The photothermographic emulsions were prepared by homogenizing 300 g of the silver halide-silver behenate dry soaps described above with 525 g toluene, 1675 g 2-butanone and 50 g poly(vinylbutyral) (B-76, Monsanto).

The homogenized photothermographic emulsion (500 g) and 100 g 2-butanone were cooled to 55° F. with stirring. Additional poly(vinylbutyral) (75.7 g B-76) was added and stirred for 20 minutes. Pyridinium hydrobromide perbromide (PHP, 0.45 g) was added and stirred for 2 hours. The addition of 3.25 ml of a calcium bromide solution (1 g of $CaBr_2$ and 10 ml of methanol) was followed by 30 minutes of stirring. The temperature was raised to 70° F. and the following were added in 15 minute increments with stirring:

3 g of 2-(4-chlorobenzoyl)benzoic acid

IR Dye solution (8.8 mg of IR Dye, S-1, in 7.1 g DMF)

8.2 g of supersensitizer solution (0.21 g 2-mercaptobenzimidazole, MBI, and 8 g methanol)

16.2 g 1,1-bis(2-hydroxy-3,5-dimethylphenyl) -3,5,5-trimethylhexane.

1.70 g 2-(tribromomethylsulfone)benzothiazole 0.68 g Isocyanate (Desmodur N3300, Mobay)

S-1

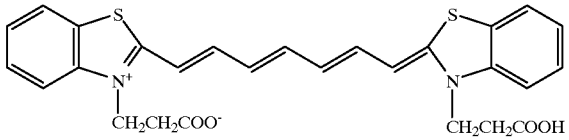

The photothermographic emulsions were coated on 3 mil ($0.76\times10^{-4}$ m) polyester base by means of a knife coater and dried at 175° F. for four minutes. The dry coating weight was 23 g/m$^2$.

An active, protective topcoat solution was prepared with the following ingredients:

256.0 g acetone 123.0 g 2-butanone 50.0 g methanol 20.2 g cellulose acetate 2.89 g phthalazine 1.52 g 4-methylphthalic acid 1.01 g tetrachlorophthalic acid 1.50 g tetrachlorophthalic anhydride The topcoat solutions were coated over the silver layer at a dry weight of 3.0 g/m$^2$. The layer was dried at 175° F. for four minutes.

The coated materials were then exposed with a laser sensitometer incorporating a 780 nm diode. After exposure, the film strips were processed at 260° F. for 10 seconds. The images obtained were evaluated on a densitometer. Sensitometric results include Dmin, Dmax (the density value corresponding to an exposure at 1.40 logE beyond a density of 0.25 above Dmin), Func.Dmax (functional Dmax was the highest density obtained before the contrast in the middle portion of the DlogE curve dropped by 20 percent), speed (relative speed at a density of 1.0 above Dmin versus example 1 set at 100), delta speed (change in speed given in logE values versus example 1) and Cont (contrast measured as the slope of the line joining the density points of 0.50 and 1.70 above Dmin).

Values were also obtained for haze and absorbance at 380 nm from unexposed coatings processed at 260° F. for ten seconds. Haze measurements were run on a HunterLab UltraScan spectrophotometer and the 380 nm absorbance was run on a spectrophotometer versus air.

The results are compiled in Table 1. The larger grain, 0.10 micron coatings gave 0.16 logE speed increase but the positive speed effect is offset by a series of negatives such as high Dmin, more silver required to reach Dmax or functional Dmax, much higher haze and a high absorbance at 380 nm. In order to develop a high quality photothermographic article, it was found necessary to limit the preformed silver halide grain to less than 0.10 micron.

TABLE 1

| Example | AgX Grain Size (microns) | Silver Layer Dry Weight (g/sq m) | Topcoat Layer Dry Weight (g/sq m) | Ratio Ag/TC Solids | Dmin | Dmax | Func. Dmax | Speed | ΔSpd | Cont | Haze | 380 nm abs |
|---|---|---|---|---|---|---|---|---|---|---|---|---|
| 1 | 0.055 | 23.0 | 3.00 | 7.7 | 0.11 | 3.57 | 3.34 | 100 | — | 5.7 | 12.6 | 0.45 |
| 2 | 0.088 | 23.2 | 3.00 | 7.7 | 0.14 | 3.21 | 3.04 | 132 | +0.12 | 5.0 | 20.4 | 0.83 |
| A | 0.100 | 23.0 | 3.00 | 7.7 | 0.14 | 2.93 | 2.28 | 123 | +0.09 | 4.9 | 21.3 | 0.88 |
| 3 | 0.055 | 21.8 | 2.76 | 7.9 | 0.11 | 3.27 | 3.02 | 98 | −0.01 | 5.3 | 12.4 | 0.45 |
| 2 | 0.088 | 23.2 | 3.00 | 7.7 | 0.14 | 3.21 | 3.04 | 132 | +0.12 | 5.0 | 20.4 | 0.83 |
| B | 0.100 | 28.8 | 3.72 | 7.7 | 0.16 | 3.52 | 3.02 | 144 | +0.16 | 4.8 | 27.3 | 1.15 |

Example 1, 2, A in table 1 indicate that if the silver coating weight is kept constant one gets lower Dmax and especially functional Dmax as grain size increases while at the same time the haze and absorption at 380 nm increases. Whereas 0.088 micrometers may be marginally acceptable, 0.1 micrometers is clearly unacceptable for the types of applications described in this patent.

Example 3, 2, B in table 1 indicate that if silver coating weight is increased to attain an acceptable functional Dmax then the haze and 380 nm absorption increase to unacceptable levels. This again indicates that B, utilizing 0.1 micrometers grains, is clearly unacceptable.

EXAMPLES 4–11

Two binder systems were prepared to test the potential infrared antihalation dyes in photothermographic systems. The first binder system ingredients are listed below for a 100 gram batch.

7.50 g poly(vinylalcohol) (Air Products, Vinol 523)

46.23 g deionized water 46.22 g methanol 0.05 g AH test dye

The poly(vinylalcohol) (PVA) was added to the water with stirring. The temperature was raised to 190° F. and then mixed an additional 30 minutes. The temperature was lowered to 140° F. and the methanol was added very slowly with maximum agitation. The mixture was stirred an additional 30 minutes before cooling to room temperature.

The second binder solution ingredients are listed below for a 100 gram batch.

6.10 g cellulose acetate butyrate (Eastman Kodak, CAB-381-20)

63.85 g 2-butanone 30.00 g 50/50 w/w mixture of methanol and 2-butanone (to dissolve AH test dye)

0.05 g AH test dye

The antihalation dyes (0.05 g per 100 g finished binder solution) tested in the CAB resin system were first dissolved in the 50/50 mixture of methanol and 2-butanone. The dissolved dyes were then added to the CAB resin solution. The dyes tested in PVA (0.05 g per 100 g binder solution) were added directly to the PVA binder solution. The two binder solutions were coated on 3 mil ($0.76\times10^{-4}$ m) clear polyester film and dried at 190° F. for four minutes. The dry coating weight for the PVA and CAB binder solutions were 3.3 g/m$^2$ and 2.7 g/m$^2$ respectively.

Other AH candidates were also examined in the infrared photothermographic element. Dyes D-9 and D-10 were described in European Patent Application 0 403 157 and were found not to satisfy the IR/visible absorbance ratio of 30 to 1 when coated without the thermal bleaching chemistry. Infrared heptamethine sensitizing dyes containing benzothiazole nuclei, S-1 and S-2 also failed to achieve the IR/visible absorbance ratio of 30 to 1.

S-2

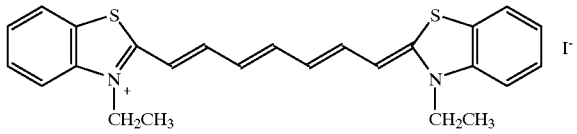

Carbon black and a metal complex, D-11, have also been used as infrared AH systems but both failed to achieve the desired 30 to 1 ratio of infrared to visible absorbance. The metal complex, D-11, can be used in silver halide systems since it will bleach completely in the developer and fix chemistry that washes into the coated material during development. The metal complex, D-11, is therefore a good example of the different needs of a photographic versus photothermographic infrared AH system.

III

D-11

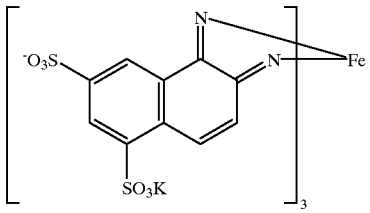

The metal complex, D-11, was added to the PVA formula at ten times the standard level (0.5%) due to a lower extinction coefficient. The results in Table 2 show that the coating has a 0.61 absorbance at λmax of 722 nm. The same coating had a 0.30 absorbance at 800 nm.

Carbon black was coated to a visible absorbance of 1.50. The carbon black coating had a constant absorbance throughout the visible wavelengths and into the infrared. The λmax absorbance of 1.50 reported in Table 2 was the reading at 800 nm. The ratio of IR/visible absorbance of 30 to 1 was not achieved with carbon black or D-11.

The results are summarized in Table 2 and include the binder system used for the antihalation dye. The coated films were evaluated on a spectrophotometer over a wavelength range of 360–900 nm. The results were tabulated for the wavelength of maximum absorbance (λmax ) and the absorbance at λmax. Visible absorbance was calculated using a MacBeth 504 Densitometer with a visible filter. The reported visible absorbance is the difference between five strips of the AH test materials and five strips of raw polyester base divided by five. The ratio of IR/vis is the ratio of absorbance at λmax over the visible absorbance.

The results in Table 2 show that the indolenine dyes produce very effective antihalation systems for photothermographic systems. An effective antihalation level (λmax abs >0.30) can be achieved with a visible (visible) absorbance of less than 0.01. The indolenine dyes also show strong thermal stability which is useful in photothermographic systems.

TABLE 2

| Ex. | AH Dye | Binder | λmax (nm) | λmax abs | Visible abs | Ratio IR/vis | 380 nm abs |
|---|---|---|---|---|---|---|---|
| 4 | D-1 | PVA | 801 | 0.55 | 0.005 | 110 | 0.017 |
| 5 | D-2 | CAB | 777 | 0.49 | 0.016 | 31 | 0.055 |
| 6 | D-3 | PVA | 800 | 0.67 | 0.007 | 96 | 0.005 |
| 7 | D-4 | PVA | 762 | 0.32 | 0.007 | 46 | 0 |
| 8 | D-5 | PVA | 818 | 0.52 | 0.009 | 58 | 0.005 |
| 9 | D-6 | PVA | 823 | 0.30 | 0.005 | 60 | 0 |
| 10 | D-7 | PVA | 766 | 0.63 | 0.011 | 57 | 0.008 |
| 11 | D-8 | PVA | 767 | 0.61 | 0.009 | 68 | 0.005 |
| C | D-9 | CAB | 825 | 0.33 | 0.034 | 10 | |
| D | D-10 | CAB | 814 | 0.33 | 0.064 | 5 | |
| E | S-1 | CAB | 775 | 0.19 | 0.036 | 5 | |
| F | S-2 | CAB | 768 | 0.27 | 0.028 | 10 | |
| G | carbon | CAB | none | 1.50 | 1.50 | 1 | |
| H | D-11 | PVA | 722 | 0.61 | 0.13 | 5 | |

EXAMPLE 12

An example of a thermal-dye-bleach construction was prepared as in Example 1 of European Patent Application 0 403 157. Guanidine trichloroacetate (40 mg) and Dye D-9 (2.5 mg) were dissolved in 4 ml of 2-butanone and 4 ml of a 15% solution of poly(vinylbutyral) (Monsanto, B-76) in 2-butanone. The solution was coated at 100 micron wet thickness and dried at 80° C. (176° F.) for 3 minutes. The coating was processed at 260° F. for 10 seconds causing a high percentage loss of visible and infrared absorption. The results are summarized in Table 3. The 30 to 1 IR/visible absorbance ratio was achieved with the IR absorbance before processing and the visible absorbance after thermal processing and was 86 (0.43 over 0.005).

TABLE 3

| Ex. | AH Dye | Thermal Processed | λmax (nm) | λmax (abs) | Visible abs |
|---|---|---|---|---|---|
| 12 | D-9 | No | 825 | 0.43 | 0.030 |
| 12 | D-9 | Yes | — | — | 0.005 |

EXAMPLES 13–22

The following constructions were coated to evaluate antihalation and acutance effects of AH dyes using the silver and topcoat formulae previously described in Examples 1–3. The preformed silver halide grain was the 0.055 micron iodobromide emulsion described in Examples 1–3. The finished photothermographic emulsion was split into 40 g portions for the various coating trials. The indolenine dye D-2 was evaluated as an acutance dye by adding 7.5 mg of D-2 dye to the 40 g portion of silver emulsion and coating as Example 14.

The finished topcoat solution described in Examples 1–3 was divided into 20 g portions. Each 20 g portion of topcoat was just sufficient to coat a 40 g aliquot of the silver formula described previously. The antihalation efficiency of the indolenine dye D-2 when added to the topcoat was evaluated by adding 7.5 mg of D-2 dye to the 20 g portion of topcoat and coating as Example 15. The topcoat solutions were coated over the silver layer at a dry weight of 3.0 g/m$^2$. The layer was dried at 175° F. for four minutes.

The following constructions were coated to evaluate antihalation and acutance effects.

(Ex I) On clear polyester base.

(Ex 14) On polyester base but with 7.5 mg of D-2 added to silver trip.

(Ex 15) On polyester base but with 7.5 mg of D-2 added to topcoat formula.

(Ex 16) On polyester base having an underlayer of D-2 in CAB, as in Example 5.

(Ex 17) On polyester base having a backing of D-2 in CAB, as in Example 5.

(Ex 18) On polyester base having an underlayer of D-3 in PVA, as in Example 6.

(Ex 19) On polyester base having a backing of D-3in PVA, as in Example 6.

(Ex 20) On polyester base having an underlayer of D-1 in PVA, as in Example 4.

(Ex 21) On polyester base having a backing of D-1 in PVA, as in Example 4.

(Ex 22) On polyester base having a thermal-dye-bleach backing of D-9 in poly(vinylbutyral) (PVB) as in Example 12.

The coated materials were then exposed with a laser sensitometer incorporating a 780 nm diode. After exposure, the film strips were processed at 260° F. for ten seconds. The wedges obtained were evaluated on a densitometer. Sensitometric results include Dmin, Dmax (the density value corresponding to an exposure at 1.40 logE beyond a density of 0.25 above Dmin), Speed (relative speed at a density of 1.0 above Dmin versus example I set at 100) Δ spd (change in speed given in logE versus example I) and Cont (contrast measured as the slope of the line joining the density points of 0.50 and 1.70 above Dmin).

Table 4 also contains columns for visible absorbance and image quality. The visible absorbance corresponds to the antihalation dyes only and has been rounded to the nearest 0.005 absorbance unit due to the higher degree of error caused by subtracting out silver and topcoat contributions. Image quality was a qualitative evaluation in halation reduction caused by the AH dyes on examination of flair or halation on the continuous wedge used for sensitometry. The image quality scale ranges from 1 to 10 where 1 represents severe halation and 10 represents no halation even at high densities and overexposure.

The data in Table 4 confirm that the dyes, D-1 to D-3, can act as effective non-bleaching antihalation systems for photothermographic materials. Halation protection can be achieved by using an antihalation back coating, an antihalation underlayer or by adding the indolenine dye to the silver or topcoat formula.

The use of D-2 as an acutance dye (examples 14 and 15) was surprising since D-2 did not interfere with the infrared sensitization and gave speeds only slightly reduced versus an AH underlayer (AHU) or back coating (AHB). The slight speed loss versus an AHU or AHB can be contributed to the lower contrast which would be beneficial for medical applications. The higher contrasts generated with an AHU or AHB coating would be preferred for graphic arts applications.

Example 15 had the indolenine, D-2, added through the topcoat formula. However, most of the indolenine dye was found to be in the silver layer. This was discovered when the topcoat was stripped off with adhesive tape and the remaining silver layer was found on the spectrophotometer to have 95% of the original infrared absorbance. Both examples 14 and 15 also had a shift in infrared absorbance curves and visible absorbance versus example 17. Examples 14 and 15 had a peak absorbance at 796 nm, a much lower visible absorbance of approximately 0.005 and a much lower shoulder absorbance at 710 nm. The absorbance curve change for examples 14 and 15 produce an IR/visible absorbance ratio of roughly 100 and easily exceeds the required 30 to 1 ratio.

Example 22 shows that a thermal-dye-bleach system can also be used to obtain high image quality.

TABLE 4

| Ex | Dye | Layer | AH Dye ($mg/m^2$) | Binder | λmax* (nm) | λmax* (abs) | Dmin | Dmax | Speed | Δ Spd | Cont | Visible abs | Image Quality |
|---|---|---|---|---|---|---|---|---|---|---|---|---|---|
| I | none | — | — | — | — | — | 0.11 | 3.39 | 100 | — | 5.35 | 0 | 1 |
| 14 | D-2 | Silver | 22 | — | 796 | 0.59 | 0.12 | 3.30 | 40 | −0.40 | 3.79 | 0.005 | 9 |
| 15 | D-2 | Topcoat | 22 | — | 796 | 0.60 | 0.11 | 3.40 | 40 | −0.40 | 3.66 | 0.005 | 9 |
| 16 | D-2 | AHU | 22 | CAB | 795 | 0.58 | 0.12 | 3.51 | 44 | −0.36 | 4.02 | 0.010 | 9 |
| 17 | D-2 | AHB | 22 | CAB | 779 | 0.46 | 0.12 | 3.40 | 47 | −0.33 | 4.48 | 0.015–0.020 | 9 |
| 18 | D-3 | AHU | 22 | PVA | 800 | 0.62 | 0.11 | 3.41 | 42 | −0.38 | 4.68 | 0.005 | 9 |
| 19 | D-3 | AHB | 22 | PVA | 800 | 0.61 | 0.11 | 3.37 | 46 | −0.34 | 4.67 | 0.005 | 9 |
| 20 | D-1 | AHU | 22 | pvA | 800 | 0.60 | 0.11 | 3.42 | 43 | −0.37 | 5.23 | 0.005 | 9 |
| 21 | D-1 | AHB | 22 | PVA | 800 | 0.60 | 0.11 | 3.41 | 45 | −0.35 | 4.78 | 0.005 | 9 |
| 22 | D-9 | AHB | 22 | PVB | 825 | 0.43 | 0.11 | 3.37 | 47 | −0.33 | 4.62 | 0.005** | 9 |

AHU = AH underlayer (between polyester and silver/topcoat coatings).
AHB = AH back layer (coated on opposite side of polyester from silver/topcoat coatings)
*Run vs Example I as background.
**Visible absorbance measured after thermal development.

EXAMPLES 23–25

A high quality reflective imaging material was also demonstrated for the infrared photothermographic element. The bulk silver and topcoat formulae were the same as described in examples 14–22. The photothermographic emulsion described in examples 14–22 was coated on 3 mil ($0.76\times10^{-4}$ m) opaque polyester film filled with barium sulfate and dried at 175° F. for four minutes. The dry coating weight was reduced in half to 11.5 $g/m^2$.

The bulk topcoat formula described in examples 14–22 was divided into 10 g portions. Example J was coated at this stage, whereas the indolenine dye, D-2, was added in different amounts to the topcoats for examples 23–25. The amounts are listed in Table 5. The topcoat solutions were coated over the silver layer at a dry weight of 1.5 $g/m^2$ and dried at 175° F. for four minutes.

The coated materials were then exposed with a laser sensitometer incorporating a 780 nm diode. After exposure, the film strips were processed at 260° F. for ten seconds. The wedges obtained were evaluated on a densitometer. Sensitometric results include Dmin, Dmax, Speed (relative speed at a density of 0.6 above Dmin versus example J set at 100) Δ spd (change in speed given in log E versus example J) and Cont (average contrast).

The results are compiled in Table 5 and show that image quality improved with the addition of the indolenine dye but at the expense of speed reduction. The image quality improvement is due to the reduction in halation attributed to D-2 dye. Image quality improvement for reflective materials could also be accomplished with AH underlayer constructions described earlier.

TABLE 5

| Ex | AH Dye | Dye-Layer | AH Dye (mg/10 g TC) | AH Dye ($mg/m^2$) | λmax (nm) | λmax abs | Dmin | Dmax | Speed | Δ Spd | Cont | Image Quality |
|---|---|---|---|---|---|---|---|---|---|---|---|---|
| J | none | — | 0 | 0 | — | — | 0.16 | 1.73 | 100 | — | 2.75 | 1 |
| 23 | D-2 | Topcoat | 1.8 mg | 5.5 | 796 | 0.16 | 0.16 | 1.73 | 37 | −0.43 | 2.68 | 3 |
| 24 | D-2 | Topcoat | 3.7 mg | 11 | 796 | 0.30 | 0.17 | 1.72 | 28 | −0.55 | 2.60 | 8 |
| 25 | D-2 | Topcoat | 7.5 mg | 22 | 796 | 0.54 | 0.19 | 1.74 | 19 | −0.70 | 2.57 | 9 |

The infrared sensitive photothermographic element of the present invention can be used in a process where there is an exposure of an ultraviolet radiation sensitive imageable medium comprising the steps of:

a) exposing the element of of the present invention when there is a transparent organic polymer support layer to infrared radiation to which said silver halide grains are sensitive to generate a latent image, b) heating said element after exposure (e.g., to the development temperatures of the photothermographic element, such as 100 degrees Centigrade to 180 degrees Centigrade) to develop said latent image to a visible image, c) positioning the exposed and developed photothermographic element with a visible image thereon between an ultraviolet radiation energy source and a ultraviolet radiation photosensitive imageable medium, and d) exposing said imageable medium to ultravilet radiation through said visible image, absorbing ultraviolet radiation in the areas where there is a visible image and transmitting ultraviolet radiation where there is no visible image.

This process is particularly useful where the imageable medium is a photoresist developable, ultraviolet radiation sensitive imageable medium. The process is effectively done by exposing the element with an infrared emitting laser or infrared emitting laser diode. The process is also particularly useful where said imageable medium comprises a printing plate.

What is claimed is:

1. An infrared sensitized photothermographic silver halide element comprising a support layer having on at least one surface thereof a photothermographic composition comprising a binder, a light insensitive silver source, a reducing agent for silver ion, a heteroaromatic mercapto compound or heteroaromatic disulfide compound as a supersensitizer, and infrared radiation sensitive preformed silver halide grains having number average particle size of from 0.01 to 0.08 microns with at least 80% of all grains with ±0.05 microns of the average, in combination with an antihalation layer having an absorbance ratio of IR absorbance (before exposure)/visible absorbance (after processing) >30, and an IR absorbance of at least 0.3 within the range of 750–1400 nm and an optical density of less than 0.03 in the visible region.

2. The element of claim 1 whereby the antihalation layer comprises either a permanent non-bleaching antihalation dye or a thermal bleaching antihalation dye.

3. The element of claim 1 wherein the number average particle size of said preformed silver halide grains is between 0.03 and 0.07 micrometers.

4. The element of claim 1 wherein the number average particle size of said preformed silver halide grains is between 0.04 and 0.06 micrometers.

5. The element of claim 1 which after thermal development for thirty seconds at 140° C. has an optical density at 380 nanometers of less than 0.1.

6. The element of claim 5 having an optical density at 380 nm after said thermal development of less than 0.05.

7. The element of claim 1 which after thermal development for thirty seconds at 140° C. has an optical density at 380 nm of less than 0.10.

8. The element of claim 7 having an optical density at 380 nm after said thermal processing of less than 0.05.

9. The element of claim 1 in which said support layer comprises a transparent organic polymeric layer.

10. The element of claim 1 wherein said antihalation layer comprises a permanent non-bleaching antihalation dye selected from the group consisting of

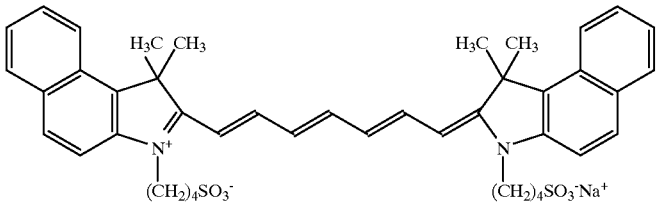
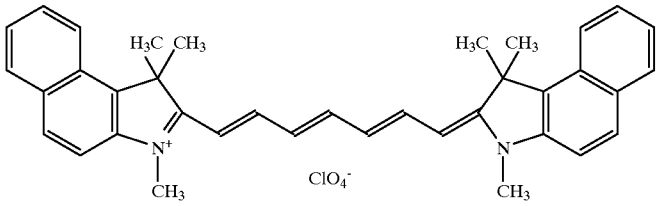
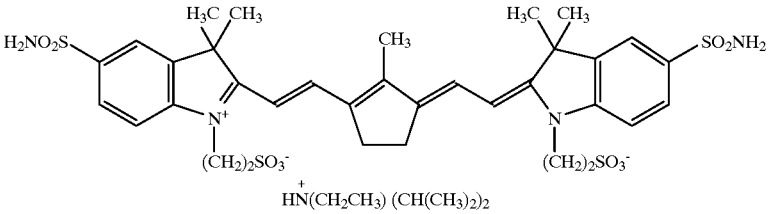
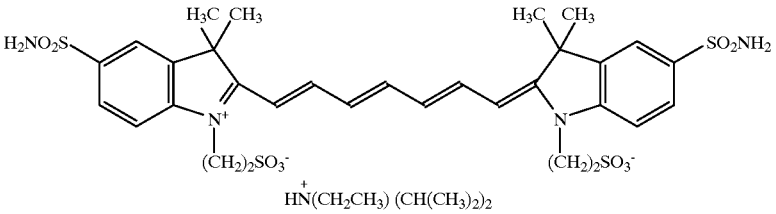
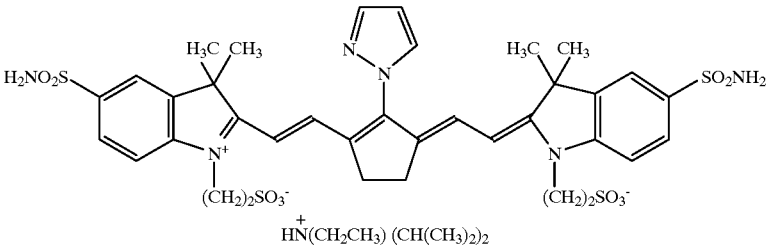
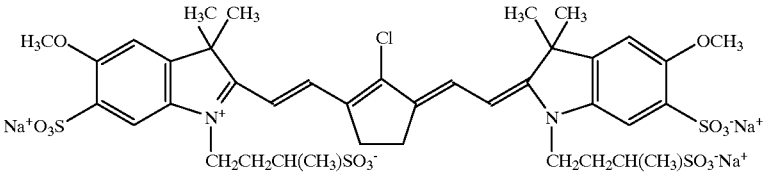
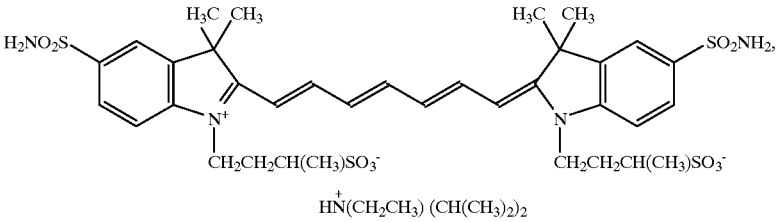
and -continued

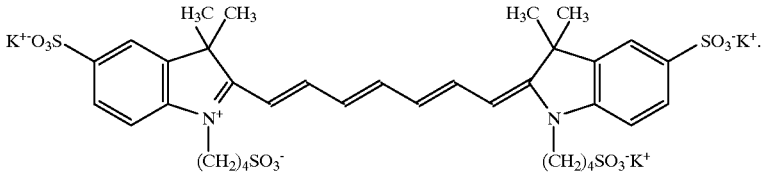

11. The element of claim 1 wherein said antihalation layer comprises a thermal bleaching antihalation dye selected from the group consisting of

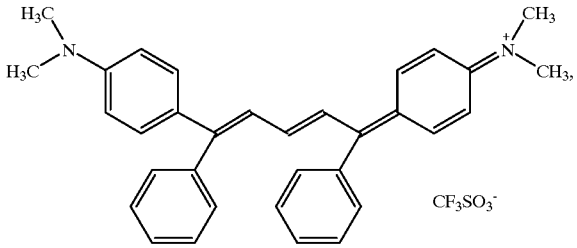

and

-continued

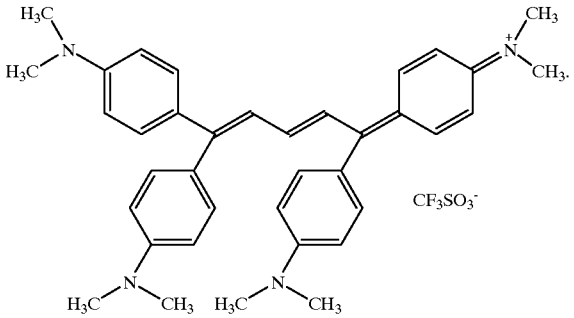

12. The element of claim 1 wherein said supersensitizer is 2-mercaptobenzimidazole, 2-mercapto-5-methylbenzimidazole, or 2-mercaptobenzothiazole.

13. The element of claim 1 further comprising a phthalazine or phthalazinone derivative as a toner.

* * * * *